US006123485A

United States Patent [19]

Mirmiran et al.

[11] Patent Number: 6,123,485

[45] **Date of Patent: *Sep. 26, 2000**

[54] PRE-STRESSED FRP-CONCRETE COMPOSITE STRUCTURAL MEMBERS

[75] Inventors: Amir Mirmiran, Orlando; Mohsen Shahawy, Tallahassee, both of Fla.

[73] Assignee: University of Central Florida, Orlando, Fla.

[ * ] Notice: This patent is subject to a terminal disclaimer.

[21] Appl. No.: 09/018,114

[22] Filed: Feb. 3, 1998

[51] Int. Cl.[7] ..... E02D 11/00; E02D 5/10

[52] U.S. Cl. ..... 405/252; 52/721.4; 52/736.3; 405/232; 405/256

[58] Field of Search ..... 405/232, 216, 405/253, 254, 255, 256, 252; 52/721.4, 723.1, 724.5, 736.3, 737.4, 738.1

[56] References Cited

U.S. PATENT DOCUMENTS

| | | | |
|---|---|---|---|
| 1,804,320 | 5/1931 | Cross | 52/721.4 X |
| 1,858,512 | 5/1932 | Langenberg et al. | 52/721.4 |
| 1,924,346 | 8/1933 | Blumenthal | 52/721.4 X |

(List continued on next page.)

FOREIGN PATENT DOCUMENTS

| | | | |
|---|---|---|---|
| 0078014 | 5/1985 | Japan | 405/256 |

OTHER PUBLICATIONS

ENR, Jan. 6, 1997, *Composite Piles Gaining Ground,* Matthew Phair.

Dupont Composites, Apr. 22, 1997, *Hardcore Fiberglass Tubular Piling*Advertising brochures and picture, (13) pages.

Mirmiran, A., and Shahawy, M. (1996). "A New Concrete–Filled Hollow FRP Composite Column." *Composites Part B: Engineering,* 27B(3–4), 263–268.

Mirmiran, A., and Shahawy, M. (1997). "Behavior of Concrete Columns Confined by Fiber Composites." *Journal of Structural Engineering*, ASCE, 123(5), 583–590.

Mirmiran, A. and Shahawy, M. (1997). "Dilation Characteristics of Confined Concrete." *Mechanics of Cohesive–Frictional Materials,* 2(3), 237–249.

Stapleman, Jan (1997). "Pile on the Abuse, The U.S. Navy calls composite piles into service in the harsh Gulf of Mexico environment." *Composites Technology,* Sep./Oct. 1997.

(List continued on next page.)

*Primary Examiner*—Dennis L. Taylor

*Attorney, Agent, or Firm*—Brian S. Steinberger; Law Offices of Brian S. Steinberger

[57] ABSTRACT

Fiber reinforced plastic FRP formed about concrete piles and columns. The FRP components generally includes an exterior shell and an interior protruding portions. The concrete filled FRP tubes are enhanced by prestressing the concrete core, thereby increasing the bond with the tube and placing the tube in an active hoop tension. The prestressing can be developed by either post-tensioning a series of strands(or tendons) that are placed inside the core, or by using expansive core materials which do expand upon curing and will therefore impose an active pressure on the confining tube. The bond can be developed by either internal resin grids, FRP spirals, FRP orthotropic grids, sand-resin coating, bonding agent or protruded ribs. The system can be used as a fender pile, bearing pile, bridge pier column, or any structural column. The system can be made by pultrusion, SCRIMP, REM, centrifugal methods or hand lay-up. The invention can additionally enhance the compressive, flexural and shear strengths of concrete support columns and piles especially for infrastructures such as bridges, buildings and the like used in hurricane and seismic zone locations.

17 Claims, 10 Drawing Sheets

U.S. PATENT DOCUMENTS

| | | | |
|---|---|---|---|
| 2,850,890 | 9/1958 | Rubenstein | 52/724.5 X |
| 2,983,104 | 5/1961 | Bruns | 405/252 |
| 3,382,680 | 5/1968 | Takano | 405/252 |
| 3,502,749 | 3/1970 | Rubenstein | 156/173 |
| 3,625,012 | 12/1971 | Thorburn | 405/252 |
| 3,633,611 | 1/1972 | Wiles | 264/334 |
| 3,798,867 | 3/1974 | Starling | 52/721.4 |
| 4,018,055 | 4/1977 | Le Clereq | 52/737.4 X |
| 4,296,060 | 10/1981 | Killmeyer | 264/137 |
| 4,312,162 | 1/1982 | Medney | 52/736.3 X |
| 4,821,804 | 4/1989 | Pierce | 166/367 |
| 4,941,775 | 7/1990 | Benedict | 405/216 |
| 5,028,368 | 7/1991 | Grau | 264/69 |
| 5,209,603 | 5/1993 | Morgan | 264/256 |
| 5,215,830 | 6/1993 | Cinti | 428/606 |
| 5,218,810 | 6/1993 | Isley | 452/736.3 X |
| 5,222,769 | 6/1993 | Kaempen | 285/45 |
| 5,228,807 | 7/1993 | Wilcox | 405/255 X |
| 5,242,721 | 9/1993 | Oonuki | 428/34.5 |
| 5,320,452 | 6/1994 | Kunito | 405/250 |
| 5,326,410 | 7/1994 | Boyles | 405/216 X |
| 5,327,694 | 7/1994 | Gamel et al. | 52/736.3 X |
| 5,339,475 | 8/1994 | Jaeger | 14/73 |
| 5,359,873 | 11/1994 | Grondziel | 72/186 |
| 5,362,542 | 11/1994 | Ozawa | 428/70 |
| 5,391,019 | 2/1995 | Morgan | 405/128 |
| 5,555,696 | 9/1996 | Morrison et al. | 52/721.4 X |
| 5,587,035 | 12/1996 | Greene | 156/187 |
| 5,599,599 | 2/1997 | Mirmiran | 428/36.3 |
| 5,800,889 | 9/1998 | Greene | 52/724.5 X |

OTHER PUBLICATIONS

Phair, Matthew (1997). "Composite Piles Gaining Ground." (Reprinted from IHR, Jan. 6, 1997, Copyright by The McGraw–Hill Companies, Inc.).

Mirmiran, A., and Shahawy, M. (1995). "A Novel FRP–Concrete Composite Construction for the Infrastructure." *ASCE Structures Congress XIII,* Boston, MA 1663–1666.

Mirmian, A. (1995). "Concrete Composite Construction for Durability and Strength" *Symposium on Extending Lifespan of Structures,* International Association for Bridge and Structural Engineering (IABSE), San Francisco, CA 1155–1160.

Mirmiran, A., Kargahi, M., Samaan, M., and Shahawy, M. (1996). "Composite FRP–Concrete Column with Bi–Directional External Reinforcement." *NSF Sponsored 1st International Conference on Composites in Infrastructure,* Tucson, AZ, 888–902.

Mirmiran, A. and Shahawy, M. (1996) "A New Concrete–filled Hollow FRP Composite Column" *Composites* Part B27B 263–268.

Apr. 22, 1997, Dupont Hardcore Fiberglass Tubular Piling Advertising Brochures and Pictures, 13 pages.

700

712
N
713
711
714
720
710

PRE-STRESSED FRP-CONCRETE COMPOSITE STRUCTURAL MEMBERS

This invention relates to U.S. patent application Ser. No. 08/499,050 filed on Jul. 6, 1995 and now U.S. Pat. No. 5,599,599 issued on Feb. 4, 1997 by the same inventors and same assignee as the subject application.

This invention was funded in part under Contract No. B-9135 with the Florida Department of Transportation, and under Grant No. CMS-9625070 with the National Science Foundation.

This invention relates to structural support members, and in particular to a method of making and using fiber reinforced plastic composite members with interior protruding portions for use with concrete supports such as those used in pillars and columns.

BACKGROUND AND PRIOR ART

Deterioration of the nation's infrastructure has been well known in the last several years. Existing columns used for bridges formed from steel and/or concrete have numerous problems. The steel structural columns are prone to losing their structural integrity over time by corrosion due to wet weather conditions and the like. Corrosion is especially a problem for steel structural supports used in coastal areas.

Concrete bridge pier type columns are also subject to deterioration of their long-term durability and their structural durability. Permeability of the exposed concrete by water can cause the concrete to deteriorate over time. For example, in northern climate areas that are subject to the changing weather conditions due to winter and summer, moisture trapped in concrete during the winter which freezes can expand and crack the concrete piers. Furthermore, corrosion is known to occur to the reinforcing steel bars used inside concrete columns.

Known techniques such as epoxy coating and/or galvanizing the steel reinforcing bars has not been successful over long periods of time especially in severe weather environments such as the Florida Keys.

Both concrete and steel columns can additionally fail in known seismic zone areas such as Southern California. Furthermore, hurricane prone areas such as Florida can also decrease the durability of the concrete and steel.

Various proposals have been made over the years to solve the problems described above, but still fail to adequately solve all the problems described above. See For example: U.S. Pat. No. 3,520,749 to Rubenstein; U.S. Pat. No. 3,644,611 to Willes; U.S. Pat. No. 4,296,060 to Killmeyer et al.; U.S. Pat. No. 4,821,804 to Pierce; U.S. Pat. No. 5,028,368 to Grau; U.S. Pat. No. 5,209,603 to Morgan; U.S. Pat. No. 5,215,830 to Cinti; U.S. Pat. No. 5,222,769 to Kaempen; U.S. Pat. No. 5,242,721 to Oonuki et al.; U.S. Pat. No. 5,320,452 to Kunito; U.S. Pat. No. 5,339,475 to Jaeger et al.; U.S. Pat. No. 5,359,873 to Grondziel; U.S. Pat. No. 5,362,542 to Ozawa et al.; and U.S. Pat. No. 5,391,019 to Morgan.

Thus, the need exists for solutions to the above referred problems.

SUMMARY OF THE INVENTION

The first objective of the present invention is to provide a method of waterproofing and insulating the exposed concrete columns and piles of infrastructure supports.

The second object of this invention is to provide a method for protecting reinforcing bars that can used in concrete infrastructure support piles and columns from the effects of corrosion.

The third object of this invention is to provide a method for increasing the ductility of concrete support columns and piles.

The fourth object of this invention is to provide a method for improving lifespan of concrete support piles and columns without the use of additional steel reinforcing bars and cages.

The fifth object of this invention is to provide a method for enhancing the compressive, flexural and shear strengths of concrete support columns and piles.

The sixth object of this invention is to provide a concrete structural support column and pile for use in hurricane and seismic zone locations.

The seventh object is to provide a bond or shear transfer mechanism between the FRP tube (or shell) and the concrete core, by an internal resin grid or by ribs.

The eight object is to provide a bond or shear transfer mechanism between the FRP tube (or shell) and the concrete core, by FRP spirals.

The ninth object is to provide a bond or shear transfer mechanism between the FRP tube (or shell) and the concrete core, by FRP orthotropic grids.

The tenth object is to provide a bond or shear transfer mechanism between the FRP tube (or shell) and the concrete core, by sand-resin coating of the interior surface of the tube.

The eleventh object is to provide a bond or shear transfer mechanism between the FRP tube(or shell) and the concrete core, by a bonding agent.

The twelth object is to provide a bond or shear transfer mechanism between the FRP tube(or shell) and the concrete core, by protruded projections made of resin and chopped fibers.

The thirteenth object is to provide a method of prestressing concrete cores axially within FRP tubes and shells.

Another object is to provide methods for connecting(and splicing) FRP-concrete members to increase their overall lengths for use as piles, beams, and columns.

Another object is to provide methods for beam-column connections for buildings and bridge applications.

The invention consists of several embodiments of a fiber reinforced plastic(FRP) composite member for increasing the compressive, flexural and shear strengths of concrete columns and supports comprising. The basic structure includes an exterior shell component and interior protruding component with a cement core. The exterior shell is a generally cylindrical shell consisting of a multilayer filament winding or alternatively a fiber and a resin compound. The interior protruding member consists of a fiber and the resin compound within the exterior shell. A cylindrical cement core is located within the shell and about the interior protruding member, where the interior protruding member and the exterior shell provide axial and circumferential reinforcement for the cement core. Alternatively, the fiber is chosen from at least one of glass, carbon, and Kevlar. The fiber is combined with a resin chosen from at least one of polyester, vinylester, and epoxy. The exterior shell can include a multilayer tube of various forms. The multilayer tube can have an inner ply of longitudinal axial fibers and an outer ply of circumferential hoop fibers. The multilayer can alternatively have a multilayer angle ply with plus or minus $\alpha°$ winding angle. Alternatively, the multilayer can have a layer of axial longitudinal fibers sandwiched between inner and outer layers of circumferential hoop fibers.

The exterior shell has several embodiments that include a circular cross-sectional shape, a rectangular cross-sectional shape, a square cross-sectional shape, and an elliptical cross-sectional shape.

The interior protruding member has several embodiments that can include plural protrusions with inward indented cross-sectional shape and the protrusions attached to inner sides of the exterior shell. Another embodiment of the interior protruding member includes plural protrusions in ribbed cross-sectional shape with the protrusions attached to and extending outward from outer sides of the exterior shell. A still another embodiment of the interior protruding member includes intersecting angled rib beams having a star-crossed cross-sectional shape. A still another embodiment of the interior protruding member includes an inner cylinder having a circular cross-sectional shape, the inner cylinder inside and coaxial to the exterior shell. A still another embodiment of the interior protruding member includes perpendicular beams having a H cross-sectional shape. The cement core can include materials chosen from at least one of plain concrete, fiber reinforced concrete, high strength concrete, steel reinforced concrete, fiber reinforced plastic concrete, plastic reinforced concrete, expansive concrete and pre-stressed concrete.

Different types of bonding surfaces and materials and methods are described. Furthermore, the inner concrete core can be pre-stressed with rebars, expandable cement and the like. Two and three-way couplers can be used to connect together end-to-end FRP casings.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

The invention consists of hollow FRP shell filled with concrete. The core can be further reinforced with protruted FRP pattern shapes.

Specimens of concrete filled FRP tubes were made at the University of Central Florida on Dec. 9, 1994. Approximately 28 specimens(including 7 control specimens without the tubes) were built. The size of the specimens were approximately 6 inches in diameter with a 12 inch height. The small size of the specimens was done due to the limitations of testing capabilities. During testing on Jan. 6, 1995, the strength of the specimens exceeded the testing equipment and the compression machine failed. The specimens were subsequently tested at the Rinker Materials Laboratory at West Palm Beach on Feb. 14, 1995. Results of the latter tests indicate that an ⅛ inch fiberglass tube can more than triple the concrete strength as compared to not using a fiberglass tube.

Figure 1A:
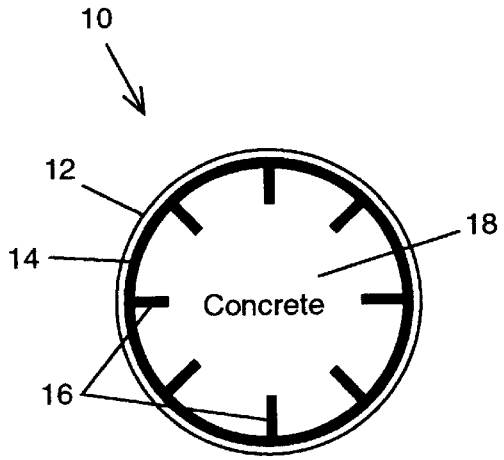
FIG. 1A is a cross-sectional view of a first preferred embodiment FRP casing with attached protrusions around a concrete member.

FIG. 1A is a cross-sectional view of a first preferred embodiment 10. Invention 10 consists of an exterior filament wound shell 12, interior protruding fiber reinforced plastic(FRP) portions 14, 16, and concrete core 18. Exterior filament shell 12 provides for several benefits including: (a) form for concrete core 18, (b) protection as a sealer or membrane against environmental effects such as corrosion, (c) axial reinforcement for the member 10, and (e) shear reinforcement for the member 10 itself. The exterior filament shell 12 is more clearly described in reference to FIGS. 3A and 3B. Referring to FIG. 1A, interior protruding FRP portions 14 and 16 consists of combinations of fiber and resin. A preferred combination consists of approximately 63% glass and 37% polyester. Types of fiber used in the invention can include but are not limited to glass, carbon, Kevlar and the like. Types of resin used in the invention can include but are not limited to polyester, vinylester, epoxy, and the like. The fiber and resin combinations can be manufactured by processes such as but not limited to hand lay-up, filament winding, pultrusion and the the like.

Hand lay-up is a method of producing fiber reinforced plastic components. The fibers can be pre-impregnated with resin(i.e. they are wetted by resin). Rolling can be done to consolidate the fibers in the resin.

The filament winding process consists of continuously wrapping impregnated fibers(wetted with resin) around a mandrel. Once the desired thickness is achieved, the process stops. After curing, the mandrel is removed from inside the hardened tube.

The pulrutsion is an automated fabrication process by which a mixture of fibers and resin is pulled through a die which has an opening similar to the desired cross-selection of the final product. The pultruted member is then cut and cured.

In FIG. 1A, interior protruding portion 14 can have a circular cross-sectional area with interior formed rib portions 16 attached to one another.

Concrete core 18 can be a normal strength concrete, normal-weight or light weight concrete, fiber reinforced concrete(FRC) or high strength concrete. A 28-day compressive strength of concrete cylinders indicate the strength of concrete. Normal strength concrete is often regarded as concrete up to 6000 psi. Fiber reinforced concrete is a mixture of regular concrete(i.e., cement, aggregate and water) and fibers (chopped fibers made of steel or plastic materials).

Figure 1B:
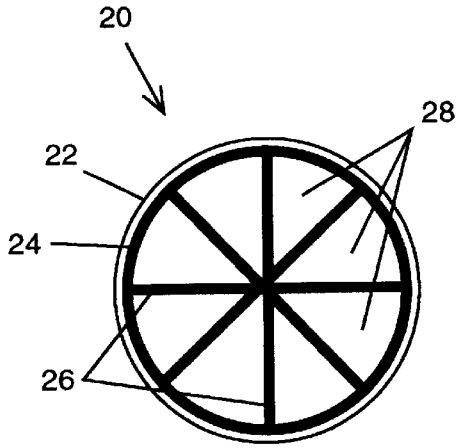
FIG. 1B is a cross-sectional view of a second preferred embodiment FRP casing with attached protrusions around a concrete member.

FIG. 1B is a cross-sectional view of a second preferred embodiment 20. Here, components 22, 24, 26 and 28 correspond to respective like components 12, 14, 16, and 18. In FIG. 1B, interior protruding FRP portion 24 can have a circular cross-sectional area with interior formed rib FRP portions 16 in an angled crossed pattern all of which are attached to one another.

Figure 1C:
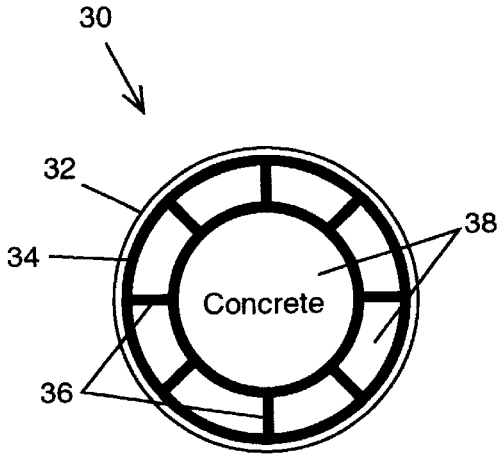
FIG. 1C is a cross-sectional view of a third preferred embodiment FRP casing with attached protrusions around a concrete member.

FIG. 1C is a cross-sectional view of a third preferred embodiment 30. Here, components 32, 34, 36 and 38 correspond to respective like components of FIGS. 1A and 1B. Additional interior protruding FRP member 37 has a circular cross-sectional shape which is coaxial to outer cylindrical FRP shape 34.

Figure 1D:
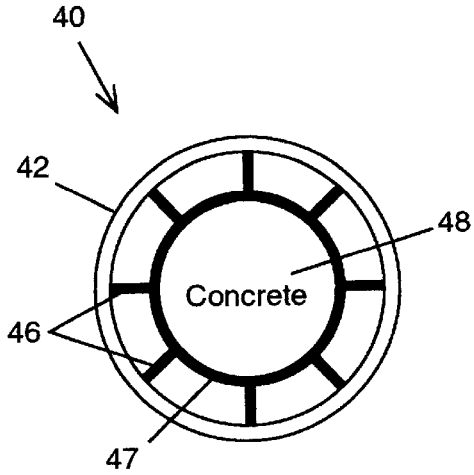
FIG. 1D is a cross-sectional view of a fourth preferred embodiment FRP casing with attached protrusions around a concrete member.

FIG. 1D is a cross-sectional view of a fourth preferred embodiment 40 consisting of components 42, 46, 47 and 48 which correspond to like components 32, 36, 37 and 38 of FIG. 1C. FIG. 1D, has rib FRP portion attached directly to outer shell 42.

Figure 2A:
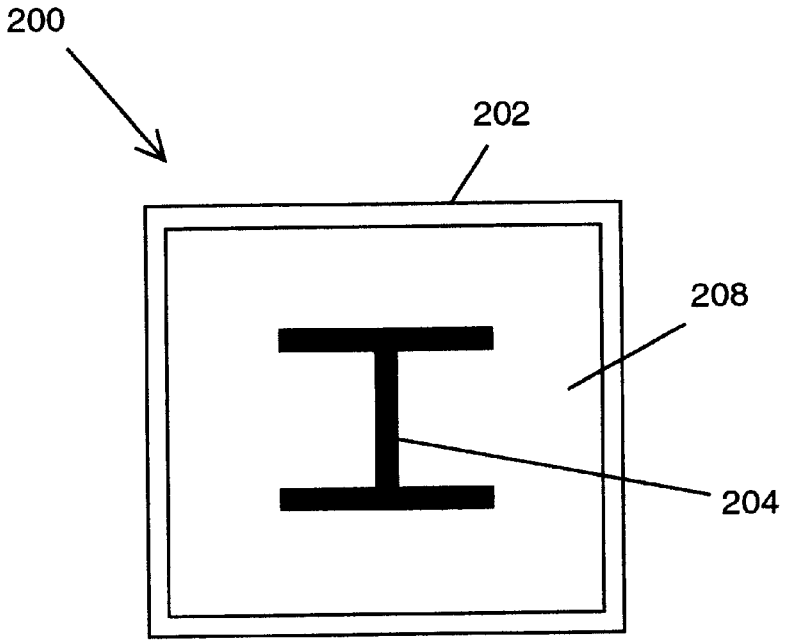
FIG. 2A is a cross-sectional view of a fifth preferred embodiment FRP casing with unattached protrusions around a concrete member.

FIG. 2A is a cross-sectional view of a fifth preferred embodiment 200. Here, outer shell 202 similar to those of the previous embodiments is formed with a square cross-sectional shape. Interior protruding FRP members 204, 206 and 207 are connected to one another as perpendicular beams having an H cross-sectional shape pattern. Although, the members 204, 206 and 207 are connected to one another they are not attached to outer shell 202. Instead concrete core 208 fills in the space between protruding members 204, 206, 208 and shell 202.

Figure 2B:
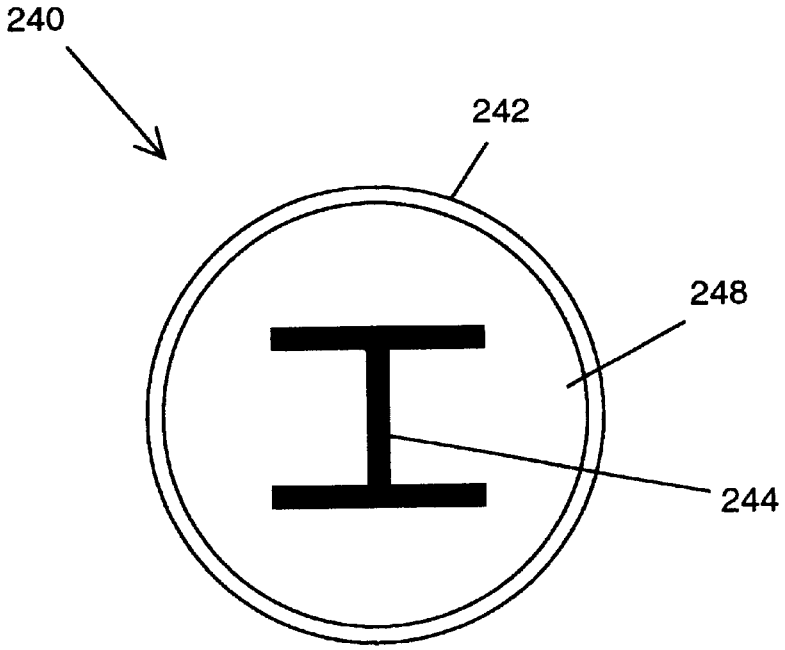
FIG. 2B is a cross-sectional view of a sixth preferred embodiment FRP casing with unattached protrusions around a concrete member.

FIG. 2B is a cross-sectional view of a sixth preferred embodiment 240. Components 242, 244, 246, 247 and 248 are similar to like respective components of FIG. 2A. Outer shell 242 has a circular cross-sectional shape.

Figure 3A:
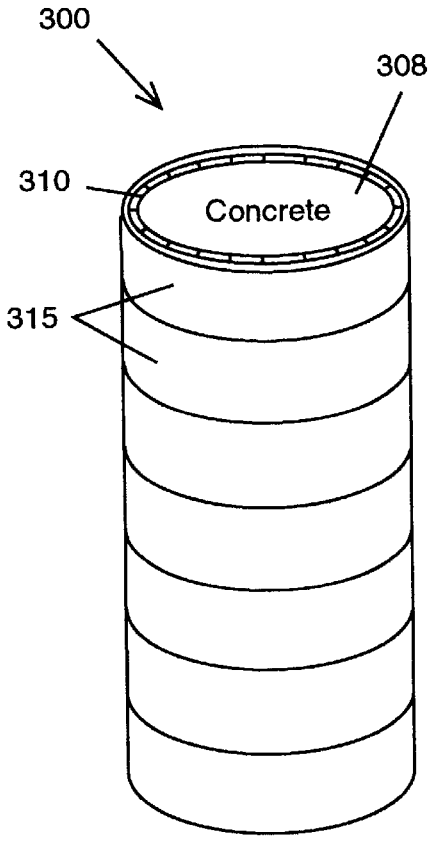
FIG. 3A is a perspective longitudinal view of a seventh preferred embodiment FRP casing with straight/normal/hoop windings and axial fibers, around a concrete member.

FIG. 3A is a perspective longitudinal view of a seventh preferred embodiment 300 and can include a multilayer tube of various forms. The multilayer tube can have an inner ply of longitudinal axial longitudinal fibers 310 and an outer ply of circumferential hoop fibers 315 both formed from the fiber materials previously described. Alternatively, the multilayer can have a layer of axial longitudinal fibers 3sandwiched between inner layer of circumferential hoop fibers (not shown) and outer layer 315 of circumferential hoop fibers. This sandwich design can prevent buckling of axial fibers 310.

Figure 3B:
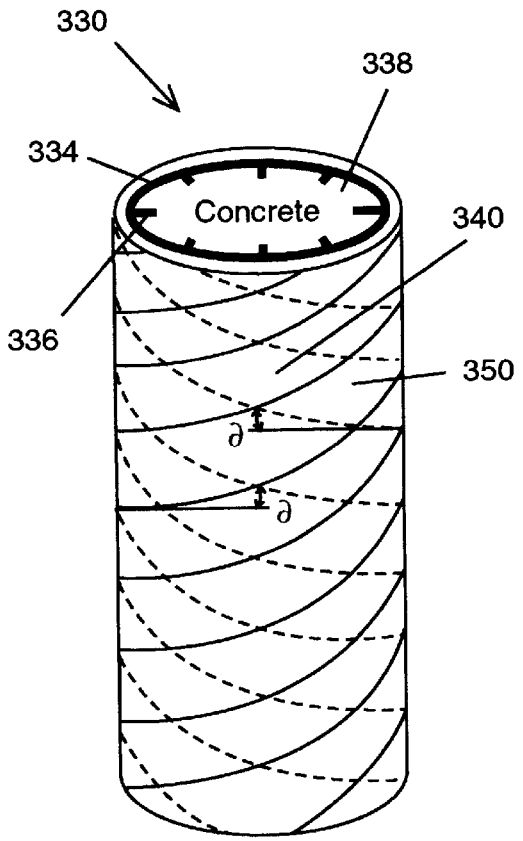
FIG. 3B is a perspective longitudinal view of the first preferred embodiment FRP casing with angle-ply cover with attached protrusions around a concrete member.

FIG. 3B is a perspective longitudinal view of another variation multilayer tube exterior shell having with angle-ply cover 340, 350 about concrete core 338. Interior FRP protrusions 334 and 336 correspond to to like respective components 14, 16 of FIG. 1A. The shell includes at least two layers 340 and 350 having an angle of plus or minus $\alpha°$ winding to one another.

Figure 4A:
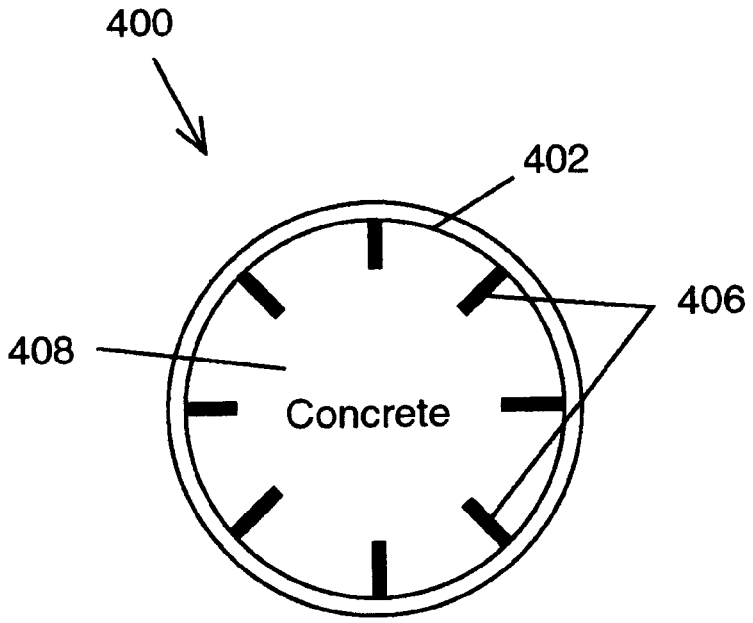
FIG. 4A is a cross-sectional view of a seventh preferred embodiment showing the filament wound shell with ribs entering toward the center.

FIG. 4A is a cross-sectional view of a seventh preferred embodiment 400 showing a filament wound shell 402 such as one of the ones described in reference to the preceding figures having a circular cross-sectional shape. The shell 402 can be attached to interior protruding longitudinal FRP rib bars 406 which are both about a concrete core 408.

Figure 4B:
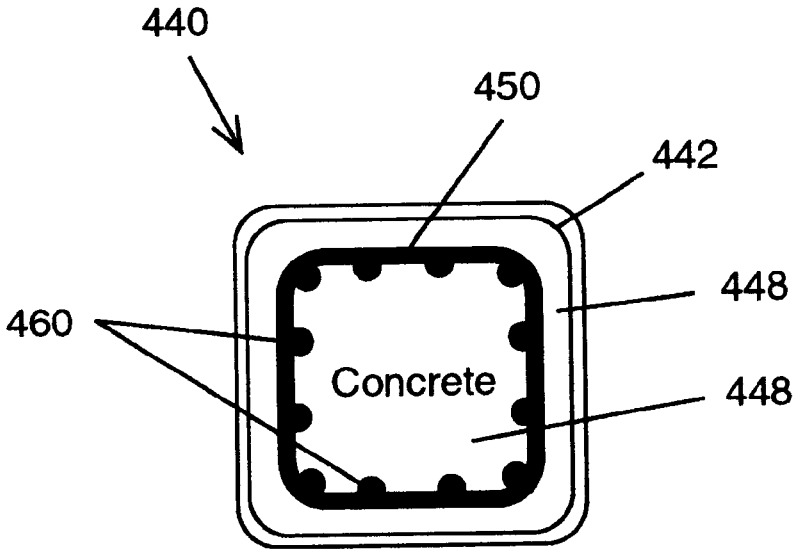
FIG. 4B is a cross-sectional view of an eighth preferred embodiment with reinforcing cage member in optional square shape.

FIG. 4B is a cross-sectional view of an eighth preferred embodiment 440 having exterior shell 442 in a square cross-sectional shape with concrete core 448 located therein. Inside shell 442 can be an steel reinforcing cage structure 450 with longitudinal FRP rods 460. Alternatively cage structure can be formed from FRP materials such as those described previously.

The exterior shells depicted in the preceding figures can provide bi-directional external reinforcement of the interior located concrete core, which includes a hoop reinforcement as well as axial reinforcement. The hoop reinforcement confines the concrete core and prevents buckling of any longitudinal fibers and bars located therein and further increases the bond strength of any reinforcing bars that can be used. The longitudinal axial fibers can improve the flexural capacity of the column and pile similar to a concrete-filled steel tube. However, the shell jacket of the subject invention further enhances the interior concrete column/piles shear strength more effectively than steel hoops and steel spirals.

Although the exterior shells are describes as multilayer fiber wound material, the exterior shells can be formed from combinations of fiber and resin such as glass and polyester that was previously described.

The invention can be used as cast-in-place or as a precast structural member. For precast members, the casting of concrete can be performed by centrifuge techniques in order to enhance the bond between the shell and the core. Cast-in-place means construction of column or pile is done at the construction site, whereas in precast member, construction is done in factory and the member is shipped to the site. In the centrifuge process, concrete is pumped from within the tube in a horizontal position while the tube is rotating, and thus concrete binds itself to the outer tube much better than regular casting.

The invention can be used as precast columns for high-rise buildings and parking garages. Likewise, the invention can be used as concrete piles and caissons. Furthermore, the invention can be used as precast or cast-in-place pier columns for bridges. The invention can have further use as a connection between columns and foundations, or alternatively as a connection between columns and beams.

Typical sizes for piles and columns using the invention can include but are not limited to a 2 or 3 foot outer diameter with an outside height of approximately 10 to 20 or more feet.

Although the invention describes using fiber and resin combinations to form the exterior and interior FRP portions, these portions can also be formed from hybrid combinations. One such hybrid combination can include but is not limited to forming interior protrusion members solely from carbon and forming exterior shell material solely from glass.

Although the invention describes various shaped FRP components, the FRP shape can be of variable shapes and sizes that each can include variable thicknesses, or constant thickness components, whereby adhering to the basic concepts described herein.

Sand-resin Coating Interior Surface

Referring to FIG. 3A, interior surface 308 can be a sand-resin coating surface area. Resin (for example epoxy) applied to the interior surface of the tube 300 by spraying and the like. Soon there-after small particles of sand can be thrown into the tube 300 to get attached to the tube interior surface at 308 via a wet resin. Once the sand and resin coat is cured, then concrete can be placed inside tube 300. The sand coating is preferred to take place in a fabricating shop rather than on site. The sand-resin coating will provide some frictional bond between the concrete core and the FRP tube 300.

Bonding Agent to Interior Surface

Referring to FIG. 3A, bonding agents are available to bond existing concrete to new (fresh) concrete. Such a bonding agent can be applied to the interior surface of the tube prior to casting concrete. It will then improve the chemical bond between the concrete core and the FRP tube, and will facilitate the shear transfer mechanism. The bonding agent can be an epoxy resin used as a structural binders.

Figure 5:
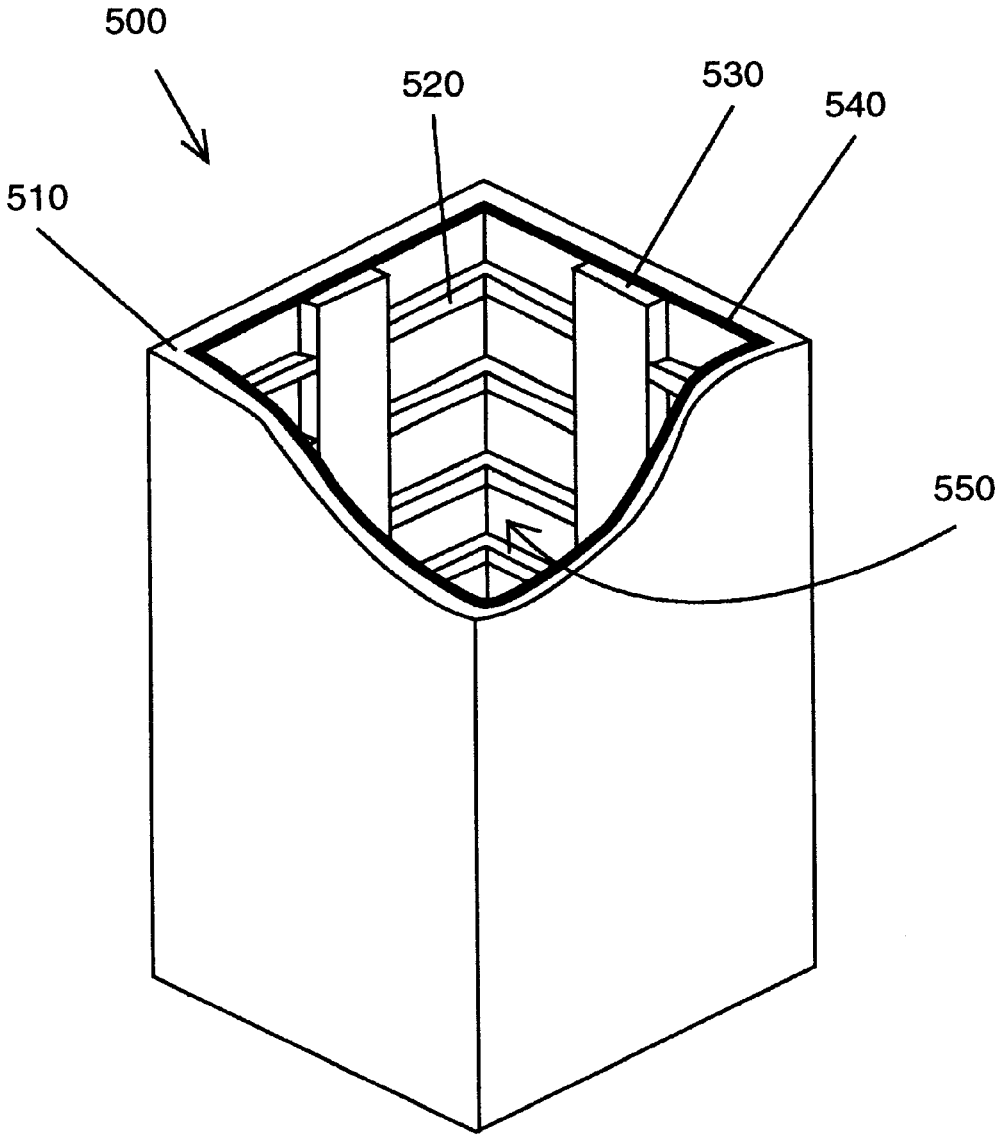
FIG. 5 shows a perspective view of a ninth preferred embodiment of a square cross-sectional shaped stiffened FRP Tube.
Figure 6:
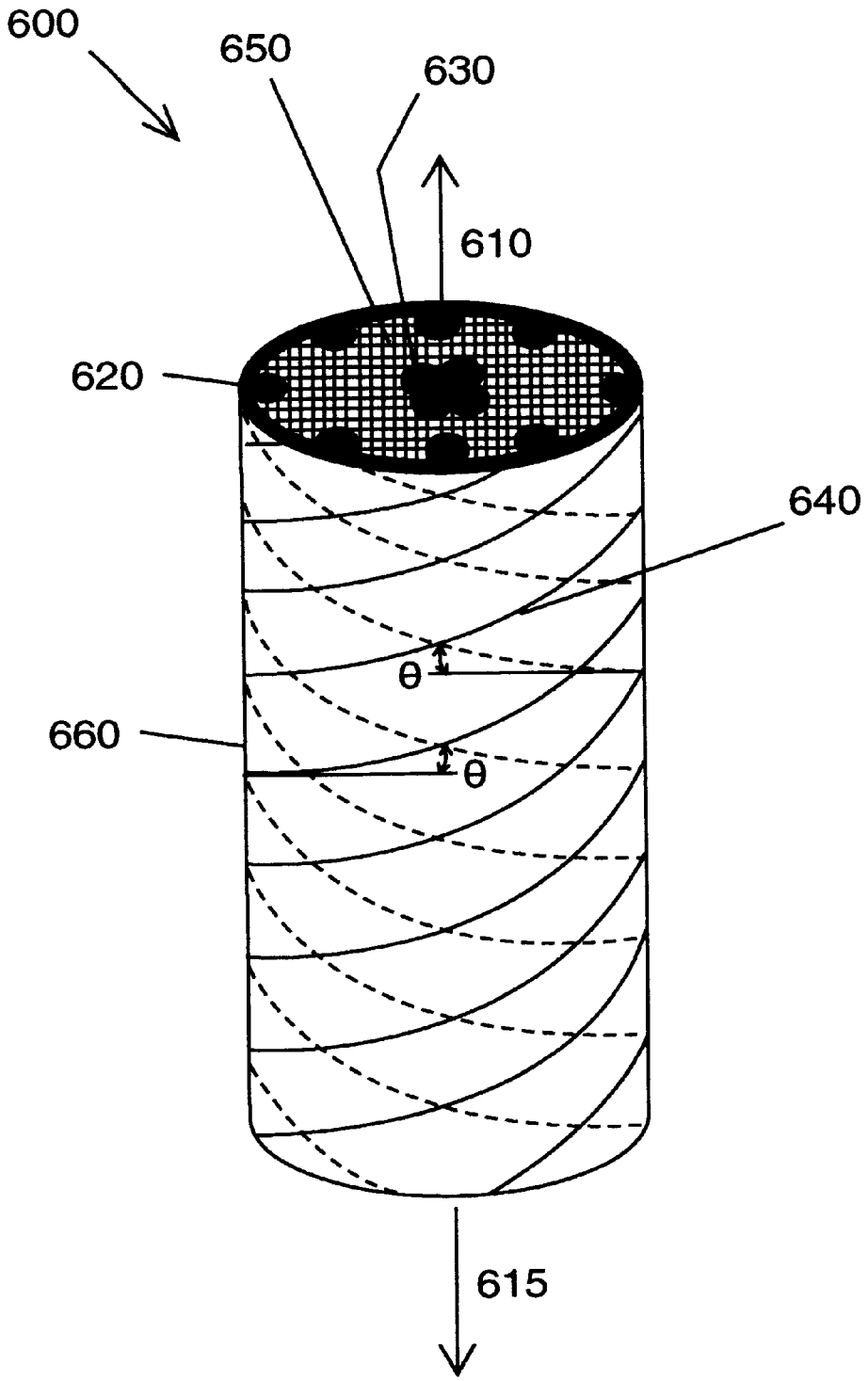
FIG. 6 shows a perspective view of a tenth preferred embodiment of a pre-stressed FRP-Concrete Composite Column.

Protruded (projections) made by excess resin and chopped fibers are described in reference to FIGS. 5–6. Here, the protrusions are generalized to include any projections of the interior surface of the tube that facilitates the shear transfer mechanism from the concrete core to the FRP tube whether or not explicitly intended for such application. Projections and protrusions can be unevenness of the interior surface of the tube such as that seen in textured surfaces, forms such as threads, and the likes. Methods of achieving such protrusions can be made by various techniques as pultrusions, hand lay-up, centrifugal techniques, SCRIMP, filament-winding, and the like, and are used to create the patterns and protrusions described above.

Additional Methods of Providing Axial Fibers

The axial fibers previously described can be applied to the FRP casing by hand (or automated) lay-up of woven roving, centrifugal techniques, filament winding over pultruted shapes, and SCRIMP®. Woven roving is a mat or sheet of fiber strands that are woven or stitched in a unidirectional or bi-directional fiber sheet that is then impregnated with resin to create a laminate. Types of woven roving include but are not limited to Knytex, and the like. Centrifugal techniques can include placing fiber sheets(such as woven roving) in inside a circular chamber. Resin is then injected into the middle of the chamber while the chamber rotates at a high speed. This causes resin to impregnate the fabric, and once cured, produces a tubular shape. SCRIMP® is a manufacturing technique that stands for Seemnn Composite Resin Infusion Molding Process" and is a vacuum assisted resin transfermolding "REM" process that results in high quality aerospace parts.

FIG. 5 shows a perspective view 500 of a ninth preferred embodiment of a square cross-sectional shaped stiffened FRP Tube. FIG. 5 shows a stiffened FRP Tube having angle piles 5 10, transverse ribs 520, longitudinal rib 530 and woven roving 540 to be described below. Transverse ribs 520 act as stiffeners and shear connectors and can be made of a number of materials that have a bond with the tube and provide strength to transfer shear to concrete. The transverse ribs 520 can be located inside the tube and perpendicular to the longitudinal axis of the tube. The ribs 520 can be made of resin such as epoxy, polyester, vinyl ester, and the like. To increase strength, one can add silica fume and chopped fibers to the resin mix. The ribs can also be made of only resin. The longitudinal ribs 530 provide a load distribution mechanism and are made of the same materials as the transverse ribs 520. Longitudinal ribs 530 can be located inside the tube and are parallel to the axis of the tube. Woven roving 510 are the axial fibers needed for the column 500 and are provided by a woven roving that is placed on the transverse ribs 520 and longitudinal ribs 530 prior to filament winding the hoop fibers which were described in previous embodiments. Angle Piles 520 are hoop fibers for confinement and shear resistance and are provided by filament winding of a series of angle plies, which were more clearly shown in previous embodiments. Core 550 is made of concrete (normal or expandable) which can be prestressed (pre-tensioned or post-tensioned(to be described later). Expansive concrete is made by using commercially available expansive agents that cause concrete to expand and not to contract. Core 550 can be cast at site, or at a fabricating shop for precast member.

Pre-stressing the Concrete Axially.

Another preferred embodiment is for prestressing the concrete axially, and therefore placing the tube in an active state of hoop tension. Prestressing can be developed by either tendons that are placed in the core, pre-tensioned or post-tensioned, or by using expansive concrete materials. The members can be partially prestressed, i.e., have both non-prestressed and prestressed reinforcements in the concrete core. The tendons such as strands, wires, and bars, and can be steel, FRP such as carbon.

All the embodiments previously described having the interior surface bonding and shear transfer mechanisms, can include prestressed, partially prestressed, reinforced (internally), and non-prestressed/non reinforced core.

FIG. 6 shows a perspective view 600 of a tenth preferred embodiment of a pre-stressed FRP-Concrete Composite Column. FIG. 6 is a prestressed FRP-Concrete Composite Column 600. Protruded ribs 620 provide the shear transfer mechanism. The protrusions 620 can be made by a number of mechanisms such as pultrusion or filament winding over a collapsible mandrel that has an uneven surface. The ribs 620 can be made of resin, or a resin mix strengthened by other materials, such as chopped fibers, fillers, silica fume, and the like. The simplest form of the protruded ribs 620 can be thought of as threads (spirally formed) inside the tube. Prestressing tendons and strands 630 can be made of a number of materials such as steel, FRP-carbon as an example). Steel tendons 630 can be stress-relieved cold-drawn single wires, or the like of sevenwire twisted strands (with low relaxation) that are typically used in construction. Also, high tensile strength prestressing bars can be used, such as carbon FRP tendons, and bars and the like. The role of these tendons 630 is to provide the tensile force that places the concrete core 650 in compression and therefore the tube 660 in hoop tension. The prestressing has two major benefits; firstly all benefits of prestressed concrete construction are applicable, mainly the fact that the concrete core 650 is in compression and therefore will not be subject to tensile cracks under service loads. Secondly, prestressing forces concrete to expand radially thereby pressing it onto the tube 660, this in itself increases the friction between the tube 660 and the core 650 and enhances the load transfer mechanism. The prestressing places the concrete 650 in active confinement, and therefore improves the load-carrying capacity of the proposed system under service loads. Prestressing can be in the form of pre-tensioning or post-tensioning , and the tendons may be bonded or unbonded. This will allow cast in place or precast-prefabricated members to be made.

Orthotropic Grid

Figures 7A, 7B:
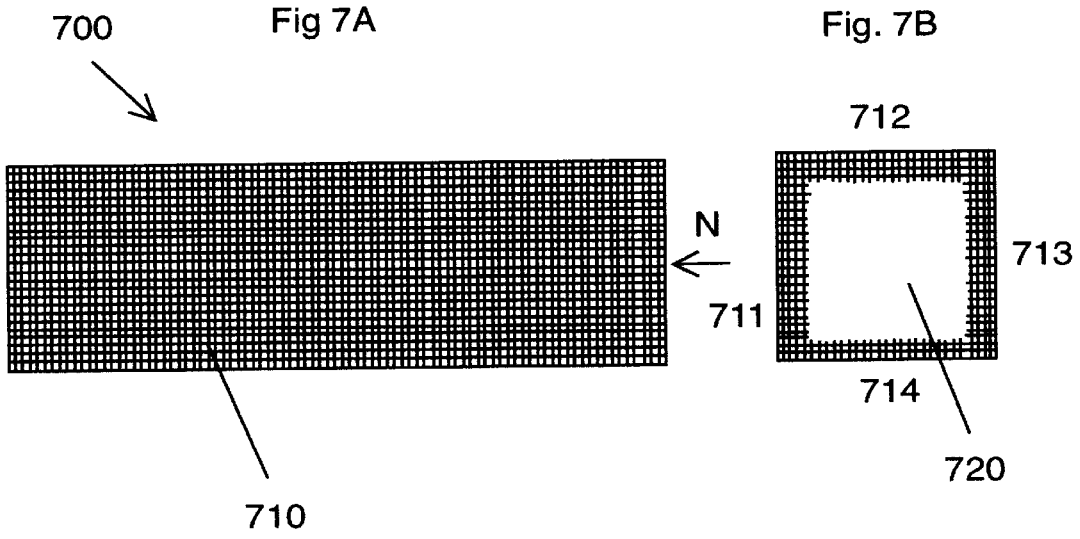
FIG. 7A is a side view of an eleventh preferred embodiment of an orthotropic grid system.
FIG. 7B is an end view of FIG. 7A along arrow N.

FIG. 7A is a side view of an eleventh preferred embodiment 700 of an orthotropic grid system with orthotropic grid 710. FIG. 7B is an end view of FIG. 7A along arrow N. The orthotropic grid system 700 is shown in FIG. 7. The grid 710 can be commercially available and is made of pultruted segments previously described. However, the same shape may be made by other fabricating methods such as hand lay-up or filament winding. In this method, if the grids 710 are made in planar format, then 4 units of them(711,712,713, 714) will be cut and attached to each other to form an open grid tube as shown in FIG. 7B. The connections can be done by plastic wires, glue and the like. Next, the axial and hoop fibers are provided by either placing the woven roving using hand lay-up and then filament winding over on top of it, or by using helical winding over the 4 unit grid system.

Figure 8:
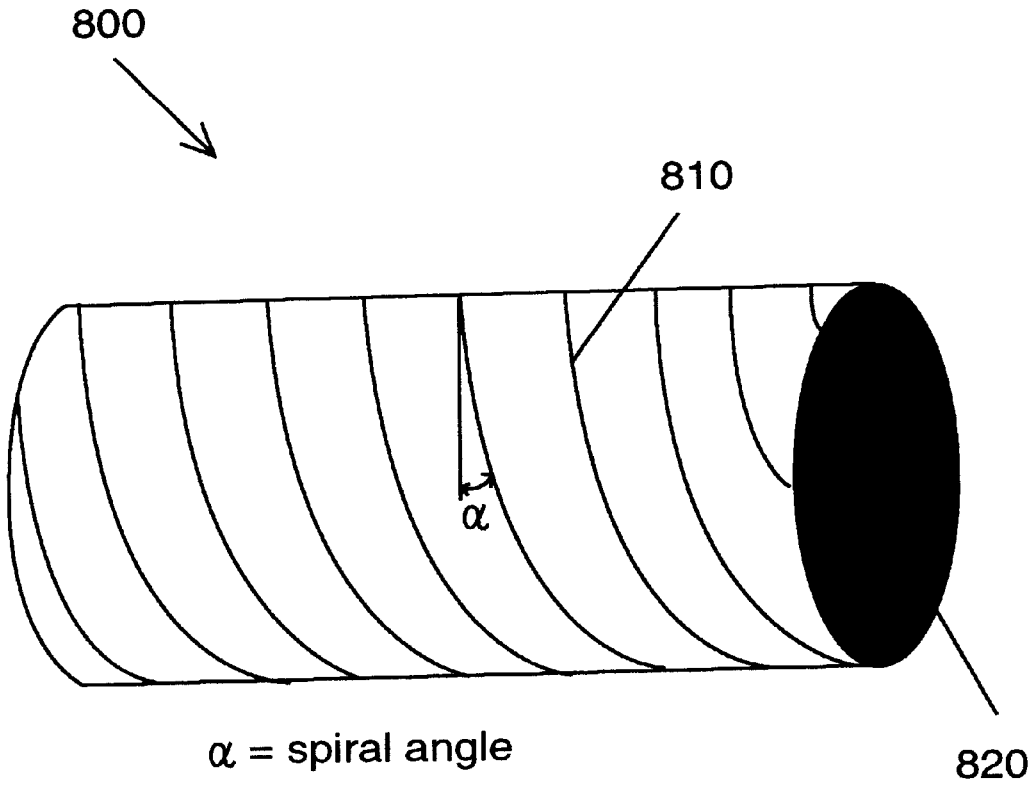
FIG. 8 is a side view of a mandrel with FRP spirals for making the protrusions previously described.

FIG. 8 is a side view 800 of a mandrel 820 with FRP spirals 810 for making the protrusions previously described. One method of making the protrusions in the interior surface of the tubes previously is to use an FRP spiral 810 that is currently available and place it on a mandrel 820 and then open it to the pitch that is selected. Then by winding the filaments over on top of these the dribs can be developed with least amount of work.

Coupler Connectors

Figure 9A:
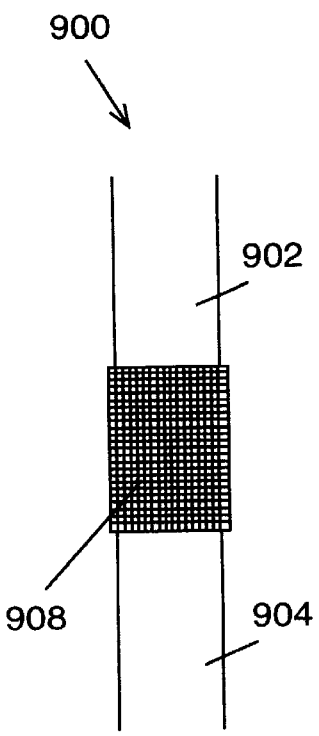
FIG. 9A is a side view of an exterior coupler/sleeve for connecting together two FRP tube casings.
Figure 9B:
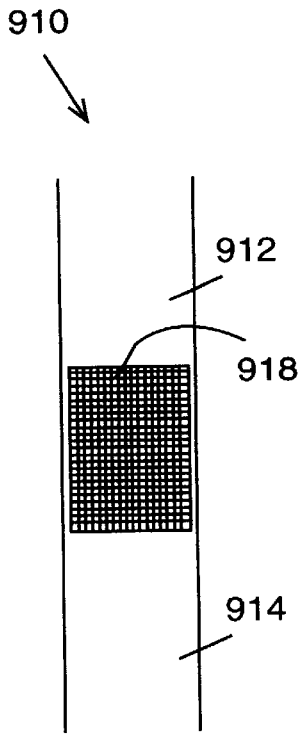
FIG. 9B is a side view of an interior coupler/sleeve for connecting together two FRP tube casings.
Figure 9C:
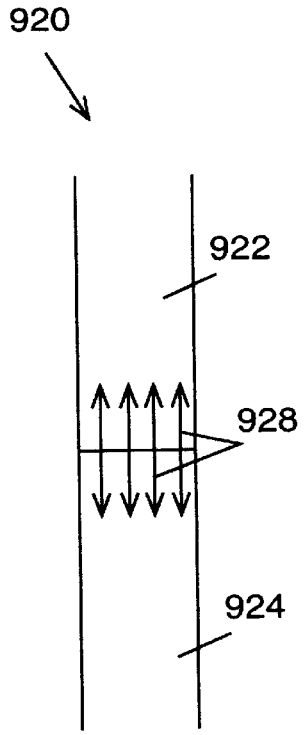
FIG. 9C is a side view of using interior rebars/dowels as a splice for connecting together two FRP tube casings end to end.

Method of connecting the FRP concrete filled FRP shells can be done with threaded couplers, sleeves, dowel bars, rebars, and the like. Without a good connection mechanism, one can not effectively use the proposed FRP-concrete members. Two types of connections are discussed: (a) splice connections to increase the overall length of pile or column (see FIGS. 9A–9C), and (2) beam-column connection for building applications (see FIGS. 10A–10B). In both cases, various methods of connections are discussed. Furthermore, the systems developed for connection can be used even when one or more of the units being attached to each other is made of materials other than the FRP-concrete composite member. This can occur when the beams in a building (for example) are reinforced or prestressed concrete, and the columns are of here. It is important to note that the proposed systems can also be used (i.e., FRP-concrete composite (members) without prestressing). FIG. 9A is a side view of an exterior coupler/sleeve 908 for connecting together two FRP tube casings. FIG. 9B is a side view of an interior coupler/sleeve 918 for connecting together two FRP tube casings. FIG. 9C is a side view of using interior rebars/dowels 928 as a splice for connecting together two FRP tube casings end to end.

Without a good connection mechanism, one cannot effectively use the FRP-concrete members in end-to-end arrangements. In all three FIGS. 9A–9C, the FRP units 902, 904, 912, 914, 924, 926 are the two columns, piles, and the like, that will be spliced together. The units 902, 904, 912, 914, 924, 926 are the FRP-concrete system previously described. Cast in place and precast units are both possible, however, it is expected that precast units made for a more economical connection system. One or more of the units 902, 904, 912, 914, 924, 926 can be a non-FRP unit such as regular reinforced concrete member, precast prestressed concrete beam, steel beams, and the like.

FIG. 9A shows an exterior Coupler/Sleeve where an FRP tube 908 of a size slightly larger than that used in the two units 902, 904 being attached. The connector 908 can be of several different forms, (1) by having threads on the interior of the sleeve and the exterior of the spliced units, (2) by grouting the connection, or (3) by bolting the sleeve into spliced unit. Coupler 908 is made of the same materials that the two units 902, 904 are made of, with axial and hoop strengths not lower than either of the two units being spliced.

FIG. 9B shows an interior Coupler/Sleeve, where an FRP tube 918 of a size slightly smaller than that used in the two units 912, 924 being attached. The connector 918 can be of several different forms; (1) by having threads on the exterior of the sleeve and the interior of the spliced units, (2) by grouting the connection, or (3) by bolting the sleeve into spliced units. Coupler 918 can be made of the same materials that the two units 912, 914 are made of, with axial and hoop strengths not lower than either of the two units being spliced.

FIG. 9C shows an FRP or Steel Reinforced Joint, where the joint/connection 928 can be made by using FRP, steel rebars, dowels, and the like, to provide the necessary load transfer mechanism between the two units. Length of rebars/dowels 928 and their size can be determined from their bond strength with concrete. For cast-in-place concrete, the dowels or rebars will be placed before poring concrete, and once concrete is cast, they will be locked in place. The dowels can have heads such as in headed reinforcement to provide means for resisting pull-out. This practice is used often in regular reinforced concrete columns. The joint can also be grouted at site, especially when the FRP units are precast with the dowels extending outward from one unit and threading into another one.

Figure 10A:
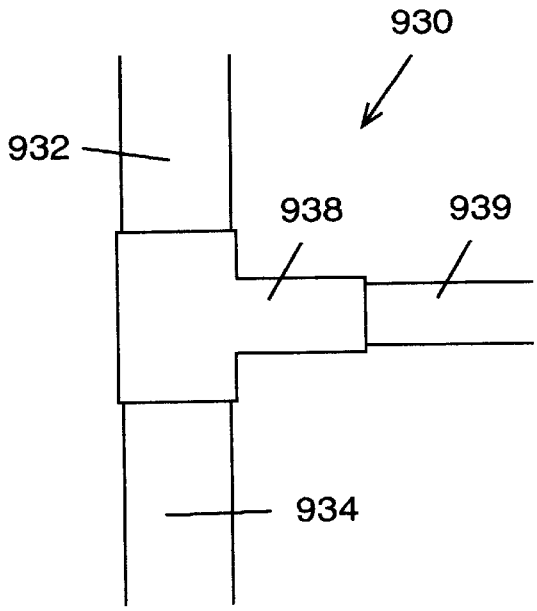
FIG. 10A is a side view of a three-way sleeve/coupler for connecting two end attached FRP tube casings to a perpendicular oriented beam.
Figure 10B:
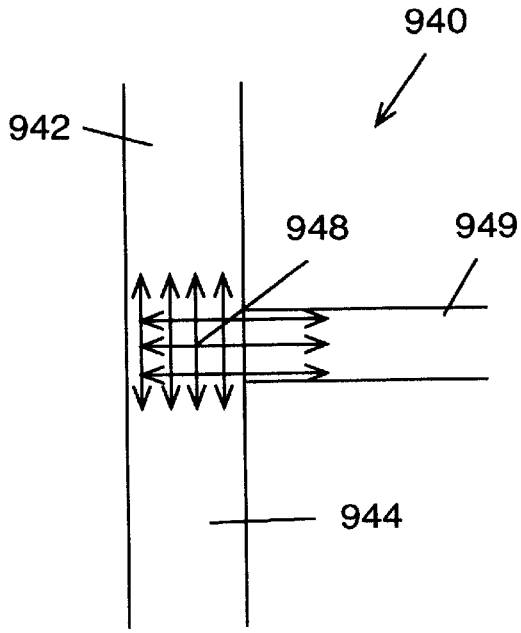
FIG. 10B is a side view of using vertical and horizontal oriented FRP type rebars/dowels to connect two FRP tube casings end to end, and to a perpendicular oriented beam.

FIG. 10A is a side view 930 of a three-way sleeve/coupler 938 for connecting two end attached FRP tube casings 932, 934 to a perpendicular oriented beam 939. FIG. 10B is a side view 940 of using vertical and horizontal oriented FRP type rebars/dowels 948 to connect two FRP tube casings 942, 944 end to end, and to a perpendicular oriented beam 949.

FIGS. 10A–10B show Beam column connections. Note that the same methods can be applied for interior columns with beams on all four sides of the plan view. Beam column connections are very important, and without them the proposed structural member can not function as part of a structural system. Two methods of connections are developed. All units 932, 934, 942, 944 can be the FRP-concrete members previously described. Alternatively, one or more of the units 932, 934, 942, 944 can be a non-FRP unit such as regular reinforced concrete member, precast prestressed concrete beam, steel beams, and the like. Cast in place and precast units can also be used. However, it is expected that precast units make for a more economical connection system.

FIG. 10A shows a sleeve connection, where the three-way coupler sleeve 938 takes the form of slightly larger that the units 932, 934, 939 which are to be connected together. The connections can be made by simple insertion and further improved by grouting. Bolting of the units to the modular connection sleeve can also be used.

FIG. 10B shows an FRP or Steel Reinforced Joint, which can be ideal when one or more of the units 942, 944, 949 is a reinforced concrete member that is cast in place. (For example, if the beams are reinforced concrete.) In this system the connection 948 is designed for transfer of shear and bending moments from beams to columns. Reinforcements/dowels 948 can be made of FRP, steel, and the like. Also, the connection can be enhanced by using fiber reinforced concrete.

Although the preferred embodiments have been described as being used with concrete columns and supports, the invention can be used as bearing piles and fender piles.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A fiber reinforced plastic(FRP) composite member for increasing the compressive, flexural and shear strengths of concrete columns and supports, comprising in combination:

an exterior shell having a contiguous side wall perimeter formed from a fiber reinforced plastic(FRP);

a cement core within the shell; and a separate interior surface layer of protruding portions other than only vertical longitudinal ribs, structurally associated with and substantially covering the interior surface of the exterior shell, the interior surface layer being directly located between the shell and the core provides a bond and shear transfer medium between the shell and the core.

2. The fiber reinforced plastic(FRP) composite member of claim 1, wherein the interior surface layer includes:

a grid having vertical and horizontal oriented cross-members.

3. The fiber reinforced plastic(FRP) composite member of claim 2, wherein the grid is formed from:

resin.

4. The fiber reinforced plastic(FRP) composite member of claim 1, wherein the interior surface layer includes:

spirals structurally associated with and substantially covering the interior surface of the exterior shell.

5. The fiber reinforced plastic(FRP) composite member of claim 4, wherein the spirals are formed from:

FRP materials.

6. The fiber reinforced plastic(FRP) composite member of claim 1, wherein the interior surface layer includes:

orthotropic grids structurally associated with and substantially covering the interior surface of the exterior shell.

7. The fiber reinforced plastic(FRP) composite member of claim 1, wherein the interior surface layer includes:

a sand and resin coating structurally associated with and substantially covering the interior surface of the exterior shell.

8. The fiber reinforced plastic(FRP) composite member of claim 1, wherein the interior surface layer includes:

a bonding agent structurally associated with and substantially covering the interior surface of the exterior shell.

9. The fiber reinforced plastic(FRP) composite member of claim 1, further comprising:

means for pre-stressing the cement core to the adhering layer and the interior surface of the exterior shell.

10. The fiber reinforced plastic(FRP) composite member of claim 9, wherein the means for pre-stressing includes:

tendons.

11. The fiber reinforced plastic(FRP) composite member of claim 1, further comprising:

a second shell formed from a fiber reinforced plastic(FRP) and concrete core; and coupler means for connecting first shell to the second shell end-to-end.

12. The fiber reinforced plastic(FRP) composite member of claim 11, wherein the coupler means includes:

an interior sleeve for fitting about an exterior portion of the first shell and the second shell.

13. The fiber reinforced plastic(FRP) composite member of claim 11, wherein the coupler means includes:

an interior sleeve for fitting about an interior portion of the first shell and the second shell.

14. The fiber reinforced plastic(FRP) composite member of claim 11, wherein the coupler means includes:

interior bars chosen from: dowels and rebars.

15. The fiber reinforced plastic(FRP) composite member of claim 11, wherein the coupler includes:

a side attachment means for attaching the end-to-end first shell and the second shell, to a perpendicular building support.

16. A fiber reinforced plastic(FRP) composite member for increasing the compressive, flexural and shear strengths of concrete columns and supports, comprising in combination:

an exterior shell having a contiguous side wall perimeter formed from a fiber reinforced plastic(FRP);

a cement core within the shell; and a separate interior surface layer of different orientation protruding portions, the separate interior surface layer structurally associated with and substantially covering the interior surface of the exterior shell, the interior surface layer being directly located between the shell and the core provides a bond and shear transfer medium between the shell and the core.

17. A fiber reinforced plastic(FRP) composite member for increasing the compressive, flexural and shear strengths of concrete columns and supports, comprising in combination:

an exterior shell having a contiguous side wall perimeter formed from a fiber reinforced plastic(FRP);

a cement core within the shell; and a separate interior surface layer chosen from at least one of a bonding agent, and a sand and resin coating, the interior surface layer structurally associated with and substantially covering a substantial surface of the interior surface of the exterior shell, the interior surface layer being directly located between the shell and the core provides a bond and shear transfer medium between the shell and the core.

* * * * *